US005103773A

United States Patent [19]

Andersson et al.

[11] Patent Number: 5,103,773

[45] Date of Patent: Apr. 14, 1992

[54] FLUID BED FURNACE

[75] Inventors: Sven B. Andersson, Lerum; Bo G. Leckner, Göthenburg; Lars-Erik Åmand, Angered, all of Sweden

[73] Assignee: Kvaerner Generator AB, Partille, Sweden

[21] Appl. No.: 690,321

[22] Filed: Apr. 26, 1991

Related U.S. Application Data

[63] Continuation of Ser. No. 531,694, Jun. 1, 1990, abandoned.

[30] Foreign Application Priority Data

Jun. 1, 1989 [SE] Sweden ..... 8901980

[51] Int. Cl.[5] ..... F22B 1/00

[52] U.S. Cl. ..... 122/4 D; 110/245; 110/216

[58] Field of Search ..... 122/4 D; 110/245, 216

[56] References Cited

U.S. PATENT DOCUMENTS

| | | | |
|---|---|---|---|
| 3,656,440 | 4/1972 | Grey | 110/216 |
| 4,531,462 | 7/1985 | Payne . | |
| 4,622,904 | 11/1986 | Murphy et al. | 122/4 D |
| 4,644,758 | 9/1987 | Gorzegno et al. | 110/245 |
| 4,665,865 | 5/1987 | Zubrod | 122/4 D |
| 4,708,092 | 11/1987 | Engstrom | 110/216 |
| 4,741,290 | 5/1988 | Kreger et al. | 122/4 D |
| 4,827,723 | 5/1989 | Engstrom et al. | 122/4 D |
| 4,936,770 | 6/1990 | Abdualally | 122/4 D |

OTHER PUBLICATIONS

"Method to Extinguish White Smoke", Japanese abstract No. 52-44432 (43) Apr. 7, 1977 (21) Appl. No. 50-120299.

"Denitrating Method for Exhaust Gas of Combustion Furnace", Japanese abstract No. 61-263617 (43), Nov. 21, 1986 (19) Appl. No. 60-104865.

*Primary Examiner*—Henry C. Yuen

*Attorney, Agent, or Firm*—Wegner, Cantor, Mueller & Player

[57] ABSTRACT

At a fluidbed furnace comprising a combustion shaft, a particle separator, a particle return passage and designed according to conventional design criteria for obtaining a good combustion at moderate temperature, a destruction of laughing gas ($N_2O$), and complete combustion of possible unburnt particles in the combustion gases is brought about in a reactor passage at the entrance of which a combustion means is located. The reactor passage is moderately cooled, so the increase of temperature in the combustion gases is maintained substantially constant unto the first convection heating surface.

6 Claims, 2 Drawing Sheets

FLUID BED FURNACE

This application is a continuation of U.S. application Ser. No. 07/531,694, filed June 1, 1990, now abandoned.

BACKGROUND OF THE INVENTION

When burning solid fuel in a fluid bed furnace the temperature is usually maintained at a moderate level of about 850° C. In this manner a sinterning of the fuel residues is prevented, and the risk of generating certain obnoxious emissions, especially nitrogen oxide, $NO_x$, is reduced. An increase of other environmentally harmful emissions, for instance $N_2O$ (laughing gas) may instead be brought about. This is especially noticeable when burning bio-mass fuels.

The object of the present invention is to propose a device for the destruction of such gaseous emissions, which will occur during combustion at comparatively moderate temperatures in a fluid bed furnace.

SUMMARY OF THE INVENTION

The invention thus refers to a fluid bed furnace comprising a furnace shaft and a particle separator as well as convection heating surfaces in a combustion gas conduit downstream of the particle separator and is characterized in that the combustion gas conduit between the gas outlet from the particle separator and the convection heating surfaces is designed as a reactor passage, that at least one combustion means is located at the upstream end thereof, and that the reactor passage is moderately cooled in such a manner that the increase of temperature in the combustion gases caused by the combustion means is maintained substantially constant unto the first convection heating surface.

The combustion means may be located at the upstream end of the reactor passage. A gas mixing device is then preferably located in the reactor passage, adjacent to the combustion means.

When the combustion means is adapted for burning solid fuel, such as sawdust, pellets of bio-mass or the like, the combustion means is preferably located adjacent to the entrance to the particle separator, whereby ashes and solid combustion residues will be caught.

DESCRIPTION OF PREFERRED EMBODIMENTS

Figure 1:
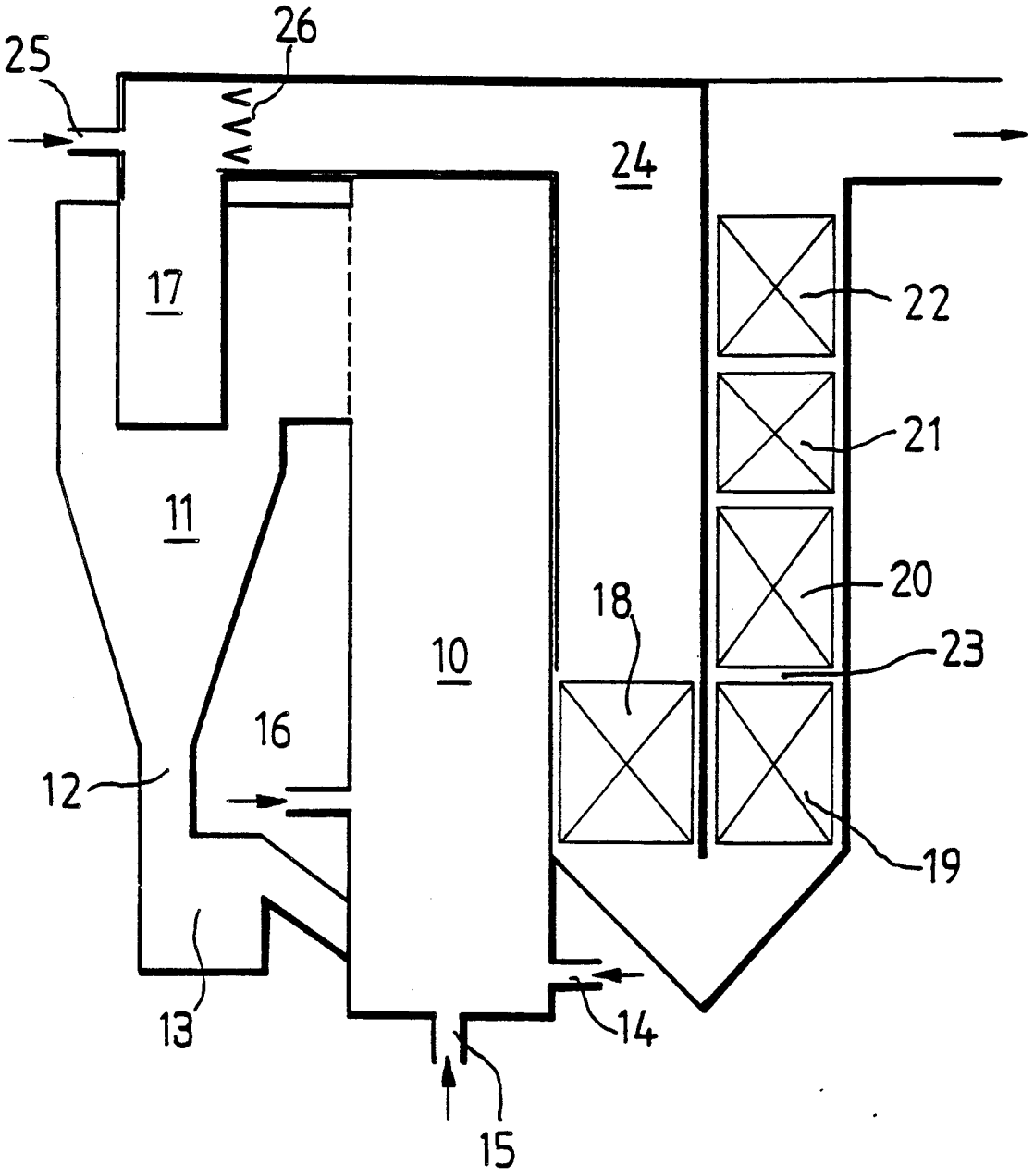
FIGS. 1 and 2 schematically show boilers having furnaces operating according to the circulating fluid bed principle (CFB), and provided with means for the destruction of $N_2O$.
Figure 2:
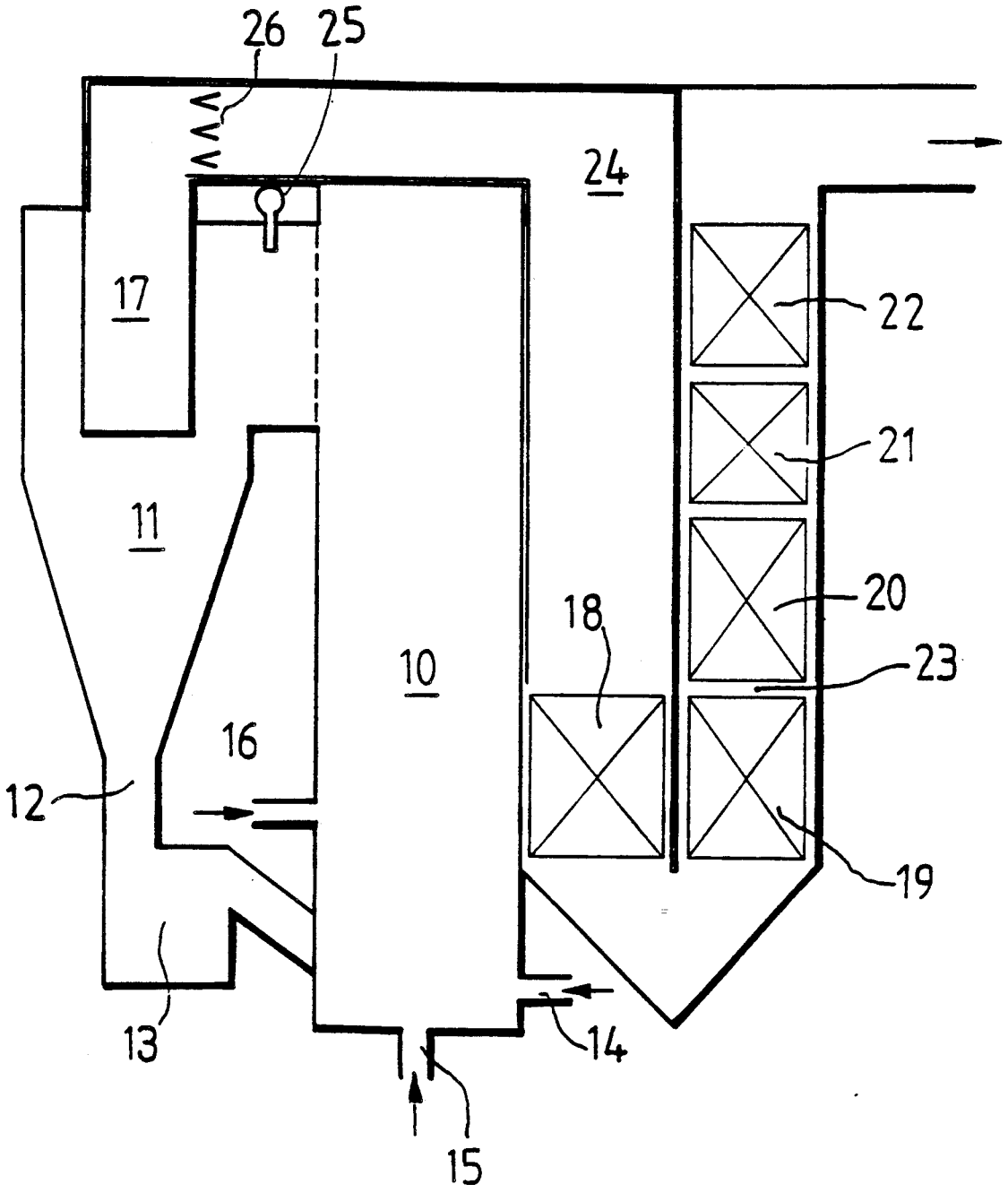

The CFB-boiler shown in FIG. 1 comprises a combustion shaft 10, a particle separator 11, preferably of the cyclone type, and a conduit 12 for returning separated particles to the combustion shaft 10. The return conduit is provided with a particle lock 13, which makes it possible to control the return flow of particles. Fuel is supplied by way of a conduit 14, primary combustion air by way of a conduit 15 and secondary air by way of a conduit 16. Inert bed material, and possibly also a sulfur reduction material may be added to the fuel and be supplied by way of conduit 14, but may alternatively be supplied by a separate conduit (not shown). Combustion residues may be removed from the lower part of the combustion shaft 10, or from the particle lock 13.

The combustion shaft is designed in the conventional manner, and is provided with satisfactory cooling, for instance by means of tube panels in the walls. By controlling the supply of primary and secondary air, the fuel and the inert bed material may be maintained in suspended state in the combustion shaft and burnt at a moderate temperature of about 850° C. A certain amount of solid material is carried over to the particle separator 11. The particles separated out will be returned to the combustion shaft, and the combustion gases will pass out through an outlet 17.

A number of convection heating surfaces 18–22 are, in a conventional manner, arranged in the combustion gas flue 23 downstream of the particle separator 11. A reaction passage 24 extends between the latter and the foremost convection heating surface 18, and a combustion means 25, for instance burning oil or gas, is located in the entrance part of the reaction passage. A gas mixing device 26 is preferably arranged adjacent to the combustion means.

The reactor passage 24 is in the schematic drawing shown with double lines. By monitoring the combustion in the shaft 10 so a temperature of about 850° C. is maintained the generation of nitrous oxides $NO_x$ is largely prevented, but instead a risk of obtaining a considerable amount of laughing gas ($N_2O$) is met. Laughing gas may, in small doses, have certain pharmaceutical applications, but the amounts actual during combustion will be environmentally disturbing. This gas has, e.g., a negative influence upon the ozone layer in space, and big outlets are not acceptable.

For the destruction of $N_2O$ a temperature of 900°–1,100° C. is needed. The $N_2O$-content in the combustion gases may vary depending upon the kind of fuel used, and the destruction takes some time. The length of the reactor passage 24 is selected in such a manner that it will take up to 5 seconds for the gases to pass the passage at normal load upon the boiler. The laughing gas ($N_2O$) will by the destruction mainly be transferred into nitrogen, $N_2$ which is normally present in the ambient air.

The reactor passage 24 is insulated and is only moderately cooled in order to prevent damages, so the increase in temperature caused by the additional combustion means 25 is maintained substantially constant up to the first convection heating surface 18. For practical reasons it may be advantageous to interconnect the convection heating surfaces, with the cooling surfaces in the combustion shaft by means of piping passing the walls of the reactor passage, and in such case an extra insulation of the passage is provided.

The embodiment described above and shown in the drawing are examples only of the invention, the details of which may be varied in many ways within the scope of the appended claims, and depending upon the required output, and the type of fuel used. Beside with the CFB-type furnaces shown, the invention, may be used with other kinds of fluid bed furnaces, or other furnaces where the laughing gas content in the combustion gases should be reduced.

The combustion means may comprise one or more additional fuel burners, or include a device for deferred combustion (i.e. final combustion outside the combustion shaft).

We claim:

1. A fluid bed furnace comprising:

(a) a vertical combustion shaft comprising a gas outlet at a top end;

(b) means for supplying solid fuel to the vertical combustion shaft and means for supplying primary combustion air to the vertical combustion shaft;

(c) particle separator means for separating particles from gas exiting the vertical combustion shaft, said particle separator means being connected to the gas outlet of the vertical combustion shaft and comprising particle output means for outputting particles separated from the gas output means for outputting gas from which particles have been removed;

(d) convection heating surfaces located in a flue downstream from the particle separator means;

(e) combustion means located downstream from the gas outlet of the vertical combustion shaft for raising the temperature of gases exiting therefrom to an elevated temperature above that in the combustion shaft, said elevated temperature being in the range of 900° to 1100° C.;

(f) means for mixing gases located downstream of the combustion means; and (g) a reactor passage extending between the gas output means of the particle separator means and the flue containing the convection heating surfaces, said reactor passage comprising insulation means for maintaining the temperature of gases substantially constant at said elevated temperature until the gases reach a first convection heating surface in the flue, wherein said combustion means is located at an entrance of the reactor passage near the gas output means of the particle separator.

2. The fluid bed furnace according to claim 1, wherein the means for mixing gases is located in the reactor passage.

3. The fluid bed furnace according to claim 1, wherein the reactor passage has a length such that gases will need up to 5 seconds to pass through the reactor passage during normal operation.

4. A fluid bed furnace comprising:

(a) a vertical combustion shaft comprising a gas outlet at a top end;

(b) means for supplying solid fuel to the vertical combustion shaft and means for supplying primary combustion air to the vertical combustion shaft;

(c) particle separator means for separating particles from gas exiting the vertical combustion shaft, said particle separator means being connected to the gas outlet of the vertical combustion shaft and comprising particle output means for outputting particles separated from the gas and gas output means for outputting gas from which particles have been removed;

(d) convection heating surfaces located in a flue downstream from the particle separator means;

(e) combustion means located downstream from the gas outlet of the vertical combustion shaft for raising the temperature of gases exiting therefrom to an elevated temperature above that in the combustion shaft, said elevated temperature being in the range of 900° to 1100° C.;

(f) means for mixing gases located downstream of the combustion means; and (g) a reactor passage extending between the gas output means of the particle separator means and the flue containing the convection heating surfaces, said reactor passage comprising insulation means for maintaining the temperature of gases substantially constant at said elevated temperature until the gases reach a first convection heating surface in the flue, wherein said combustion means is located at an entrance of the particle separator means near the gas outlet of the vertical combustion shaft.

5. The fluid bed furnace according to claim 4, wherein the means for mixing gases is located in the reactor passage.

6. The fluid bed furnace according to claim 4, wherein the reactor passage has a length such that gases will need up to 5 seconds to pass through the reactor passage during normal operation.

* * * * *